US008256927B2

(12) United States Patent
Hu et al.

(10) Patent No.: US 8,256,927 B2
(45) Date of Patent: Sep. 4, 2012

(54) ILLUMINATION DEVICE

(75) Inventors: Sheng-Hsiung Hu, Tainan County (TW); Yu-Yuan Yeh, Taoyuan County (TW); Ming-Chun Wu, Taoyuan County (TW); Ching-Po Lee, Taoyuan County (TW)

(73) Assignee: Leotek Electronics Corporation, Taoyuan County (TW)

( * ) Notice: Subject to any disclaimer, the term of this patent is extended or adjusted under 35 U.S.C. 154(b) by 544 days.

(21) Appl. No.: 12/559,143

(22) Filed: Sep. 14, 2009

(65) Prior Publication Data

US 2011/0063832 A1 Mar. 17, 2011

(51) Int. Cl.
*F21V 29/00* (2006.01)

(52) U.S. Cl. ..... 362/294; 362/373; 362/218; 362/547; 362/545; 362/382; 362/800

(58) Field of Classification Search ..... 362/294, 362/382, 391, 249.01–249.02, 249.11, 545, 362/257, 26.01, 297, 299, 308, 800, 547, 362/264, 373, 218
See application file for complete search history.

(56) References Cited

U.S. PATENT DOCUMENTS

| | | | | |
|---|---|---|---|---|
| 7,338,186 | B1 * | 3/2008 | Wu et al. | 362/294 |
| 7,654,701 | B2 * | 2/2010 | Zhang et al. | 362/294 |
| 7,682,051 | B2 * | 3/2010 | Xiao et al. | 362/364 |
| 7,682,055 | B2 * | 3/2010 | Shuai et al. | 362/373 |
| 7,686,469 | B2 * | 3/2010 | Ruud et al. | 362/101 |
| 7,699,498 | B2 * | 4/2010 | Zheng | 362/249.02 |
| 7,703,951 | B2 * | 4/2010 | Piepgras et al. | 362/373 |
| 7,712,923 | B2 * | 5/2010 | Huang et al. | 362/267 |
| 7,744,247 | B2 * | 6/2010 | Zhang et al. | 362/249.02 |
| 7,744,258 | B2 * | 6/2010 | Liu et al. | 362/373 |
| 7,753,556 | B1 * | 7/2010 | Zhang et al. | 362/249.02 |
| 7,758,207 | B1 * | 7/2010 | Zhou et al. | 362/218 |
| 7,758,211 | B2 * | 7/2010 | Zheng et al. | 362/249.02 |
| 7,771,087 | B2 * | 8/2010 | Wilcox et al. | 362/294 |
| 7,909,489 | B2 * | 3/2011 | Lin et al. | 362/373 |
| 7,934,851 | B1 * | 5/2011 | Boissevain et al. | 362/241 |
| 7,967,469 | B2 * | 6/2011 | Fang et al. | 362/249.02 |
| 8,066,407 | B2 * | 11/2011 | Remus et al. | 362/249.02 |
| 8,152,336 | B2 * | 4/2012 | Alexander et al. | 362/249.11 |
| 2006/0262545 | A1 * | 11/2006 | Piepgras et al. | 362/373 |
| 2007/0258244 | A1 * | 11/2007 | Curran et al. | 362/311 |
| 2008/0055908 | A1 * | 3/2008 | Wu et al. | 362/294 |
| 2009/0034255 | A1 * | 2/2009 | Li | 362/249 |
| 2009/0290348 | A1 * | 11/2009 | Van Laanen et al. | 362/249.02 |
| 2009/0310381 | A1 * | 12/2009 | Chang et al. | 362/555 |
| 2009/0316403 | A1 * | 12/2009 | Zhang et al. | 362/249.01 |
| 2010/0202144 | A1 * | 8/2010 | Chen | 362/249.02 |
| 2010/0226138 | A1 * | 9/2010 | Lin et al. | 362/373 |

* cited by examiner

*Primary Examiner* — Anne Hines
*Assistant Examiner* — Jose M Diaz
(74) *Attorney, Agent, or Firm* — Morris Manning & Martin LLP; Tim Tingkang Xia, Esq.

(57) ABSTRACT

An illumination device includes a lamp housing component, a main bone disposed inside the lamp housing component, and at least one light emitting component. The light emitting component has a heat sink member and a light emitting member. The heat sink member is locked on the main bone, and the light emitting member is disposed on the lamp housing component and contacts the heat sink member. According to the demand for luminance, the number of light emitting components is optionally increased or decreased on the main bone, or the main bone inside the lamp housing component is replaced by an extended main bone, so as to increase the number of light emitting components.

10 Claims, 10 Drawing Sheets

ILLUMINATION DEVICE

BACKGROUND OF THE INVENTION

1. Field of Invention

The present invention relates to an illumination device, and more particularly to an illumination device having an expandable structure, which has desirable heat dissipation effects and is easily maintained.

2. Related Art

Currently, a light emitting diode (LED) has already been used on a road lamp for illumination. The LED has advantages of a low power consumption, high luminance, and long lifetime, and thus can solve the problems such as a high power consumption and short lifetime of a conventional mercury road lamp. However, when the LED is applied to the road lamp, the problem of poor heat dissipation still occurs, and the high-temperature heat source generated by the LED causes the heats to be accumulated inside the lamp. As a result, the circuit substrates or electronic devices are damaged due to being overheated.

Therefore, a heat dissipation device is needed to divert the high-temperature heat source generated by the LED out of the lamp, so as to entirely reduce the high-temperature heat energy accumulated inside the lamp, and thus, the LED can operate to emit lights normally at a low temperature. A commonly adopted technical means is to utilize the forced convection principle of an auxiliary fan to generate forced heat exchange convection inside the lamp. The forced heat dissipation by using the auxiliary fan requires opening ventilation holes, so as to realize the purpose of rapid heat dissipation. However, the lifetime of the fan is shortened if it is operated under various severe climatic conditions, such that the cost of the lamp is increased. Moreover, the maintenance and replacement of the fan inside the lamp are rather inconvenient.

Furthermore, in the conventional heat dissipation manner, a heat-sink lamp housing having heat sink fins is manufactured by die casting molding, and the elements such as an LED and the heat-sink lamp housing are enabled to contact each other. Thus, after the heat-sink lamp housing absorbs the heat energy generated by the LED, a natural convection is directly formed by the exposed heat sink fins of the heat-sink lamp housing with the outside air, thereby dissipating the heat energy via the heat sink fins. In such a heat dissipation manner by using the housing, since the heat sink fins are exposed outside the heat-sink lamp housing, the problem of dust accumulation or bird nesting easily occurs, thereby influencing the heat dissipation effect of the natural convection and greatly reducing the heat dissipation effect of the road lamp.

However, in order to increase the heat dissipation area without compromising the structural strength, the heat-sink lamp housing formed through die casting is likely to have defects of an increased weight, restricted form, and difficulties in die sinking. On the other hand, considering the designing flexibility of products, the heat-sink lamp housing formed through die casting has a fixed structure. With such a structural design, the number of light emitting components inside the lamp cannot be increased timely depending upon the demand for the luminance of the lamp, such that the problem of lacking expandability still exists. Consequently, in order to enhance the luminance of the lamp in the heat-sink lamp housing formed through die casting, the entire set of light emitting components inside the lamp unavoidably needs to be replaced.

Therefore, how to effectively improve the air convection structure inside the road lamp and the expandable structure of the lamp is urgently researched by relevant manufacturers in this industry.

SUMMARY OF THE INVENTION

Currently, a road lamp is configured with a heat-sink lamp housing manufactured by die casting, which has a high material cost and a high manufacturing cost. The light emitting components (for example, LED elements) are directly locked on the heat-sink lamp housing, and cannot be easily disassembled and assembled during maintenance. In addition, the heat-sink lamp housing is a main supporting architecture of the entire lamp, which increases the entire weight of the lamp while enhancing the strength thereof. Moreover, due to the fixed external structure of the heat-sink lamp housing, the size and form of the heat-sink lamp housing need to be redesigned if the luminance of the lamp is to be enhanced by increasing the number of the light emitting components.

In an embodiment of the present invention, an illumination device is provided. The illumination device comprises a lamp housing component, a main bone, and at least one light emitting component. The main bone is disposed inside the lamp housing component. The light emitting component has a heat sink member and a light emitting member. The heat sink member is disposed inside the lamp housing component and is connected to the main bone, and the light emitting member is disposed on the lamp housing component and contacts the heat sink member.

In addition, the light emitting member further comprises a circuit board, at least one LED, and a secondary optical member. The circuit board is a low-thermal-resistance metal core printed circuit board (MC-PCB) and contacts the heat sink member. The LED is electrically connected to the circuit board. The secondary optical member is disposed on the circuit board and covers the LED.

The efficacy of the present invention is that, according to the demand for luminance, the light emitting components are optionally increased or decreased on the main bone, or the main bone inside the lamp housing component is replaced by an extended main bone, so as to increase the number of the light emitting components. Moreover, if one of the light emitting components fails, the failed light emitting component is directly disassembled from the main bone and a new light emitting component for replacement is directly assembled on the main bone, and thus, the light emitting components can be easily assembled, dissembled, and replaced.

BRIEF DESCRIPTION OF THE DRAWINGS

The present invention will become more fully understood from the detailed description given herein below for illustration only, and thus is not limitative of the present invention, and wherein.

DETAILED DESCRIPTION OF THE INVENTION

To make the objectives, structures, features, and functions of the present invention more comprehensible, the present invention is illustrated below in detail through the embodiments.

Figure 1:
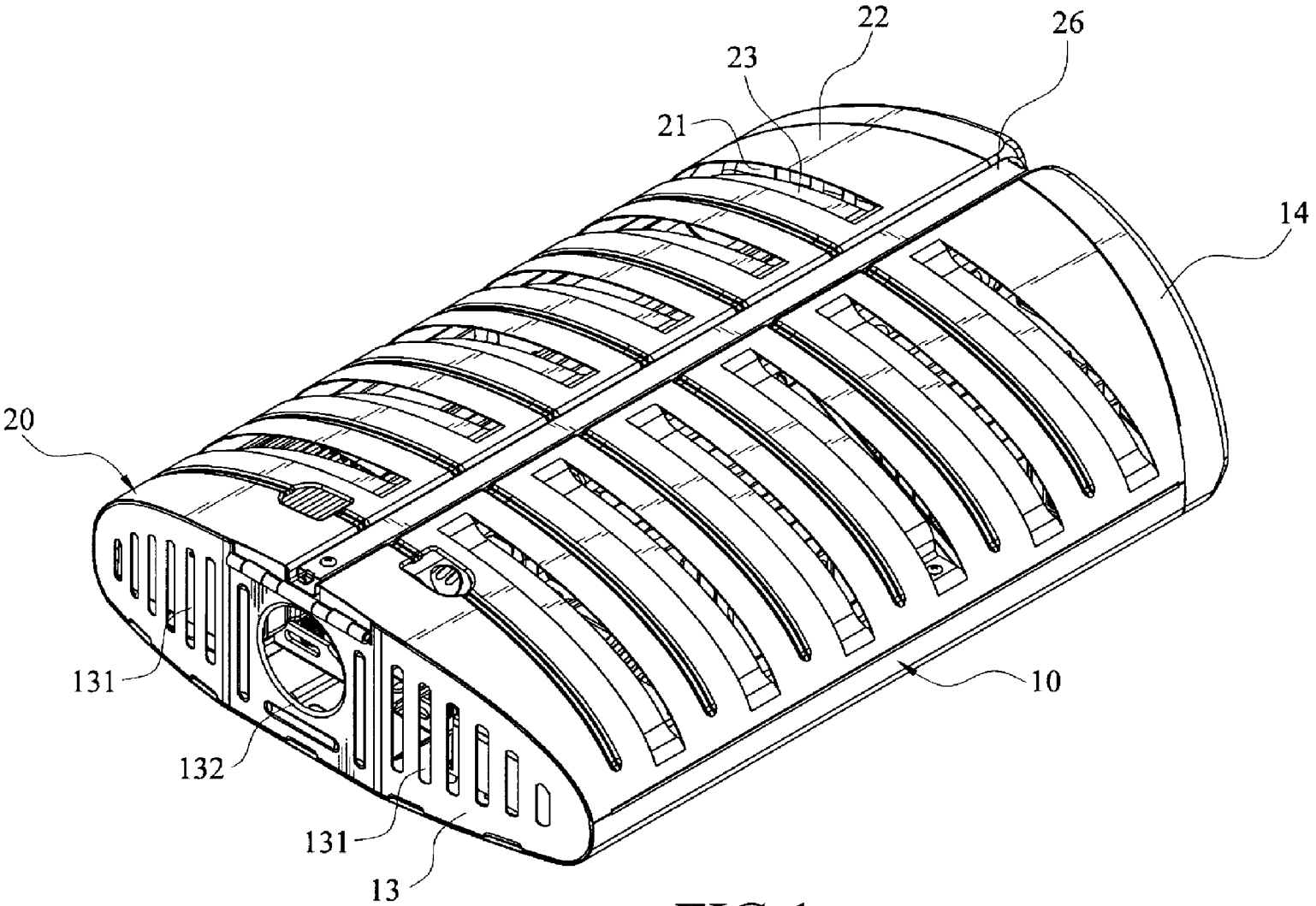
FIG. 1 is a schematic outside view of an embodiment of the present invention.
Figure 2:
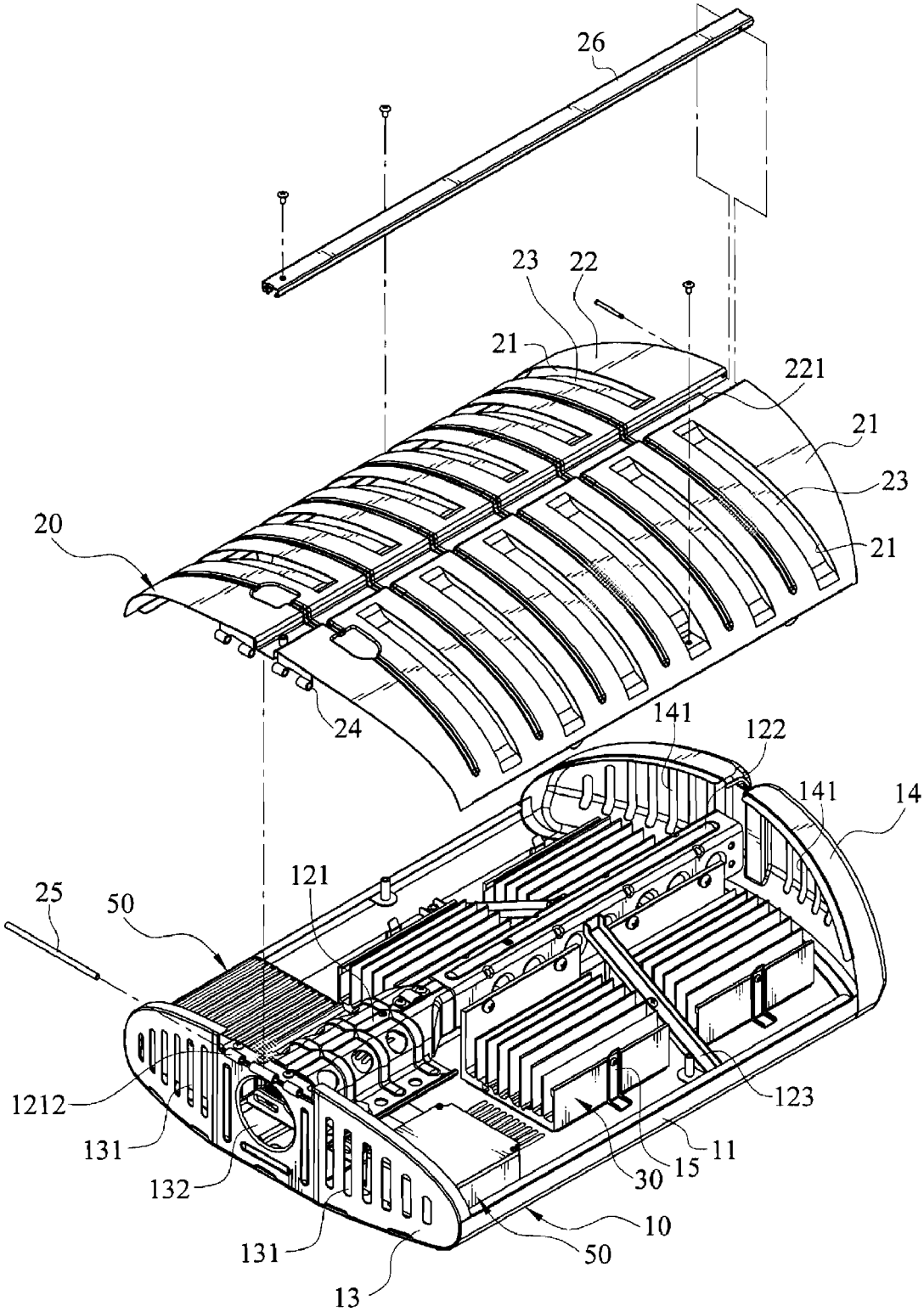
FIG. 2 is a schematic partially exploded view of an embodiment of the present invention.
Figure 3:
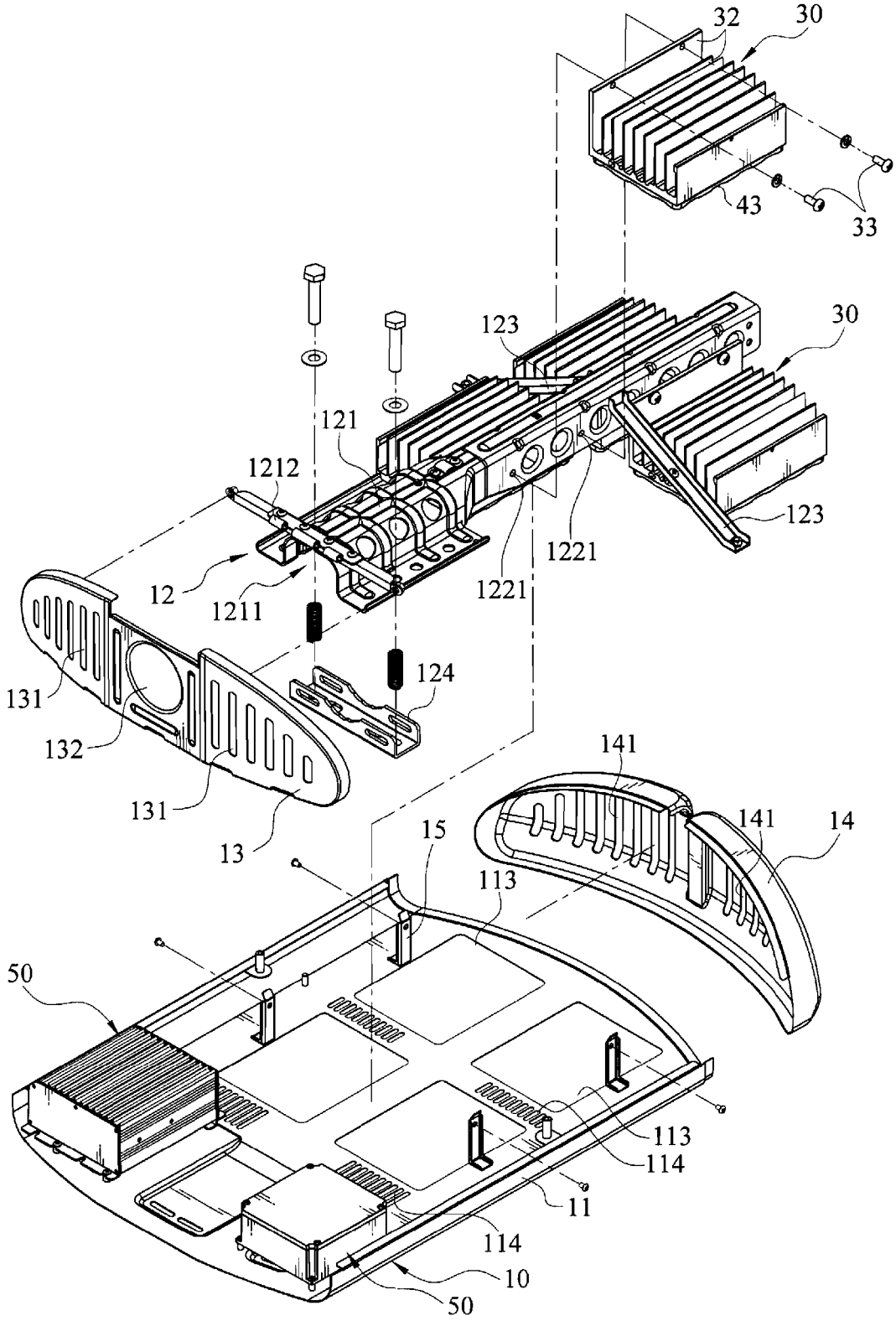
FIG. 3 is a schematic exploded view of an embodiment of the present invention.

FIG. 1 is a schematic outside view of an embodiment of the present invention, FIG. 2 is a schematic partially exploded view of an embodiment of the present invention, and FIG. 3 is a schematic exploded view of an embodiment of the present invention. As shown in FIGS. 1, 2, and 3, an illumination device disclosed in the present invention substantially comprises a lamp housing component and a light emitting component.

Figure 7:
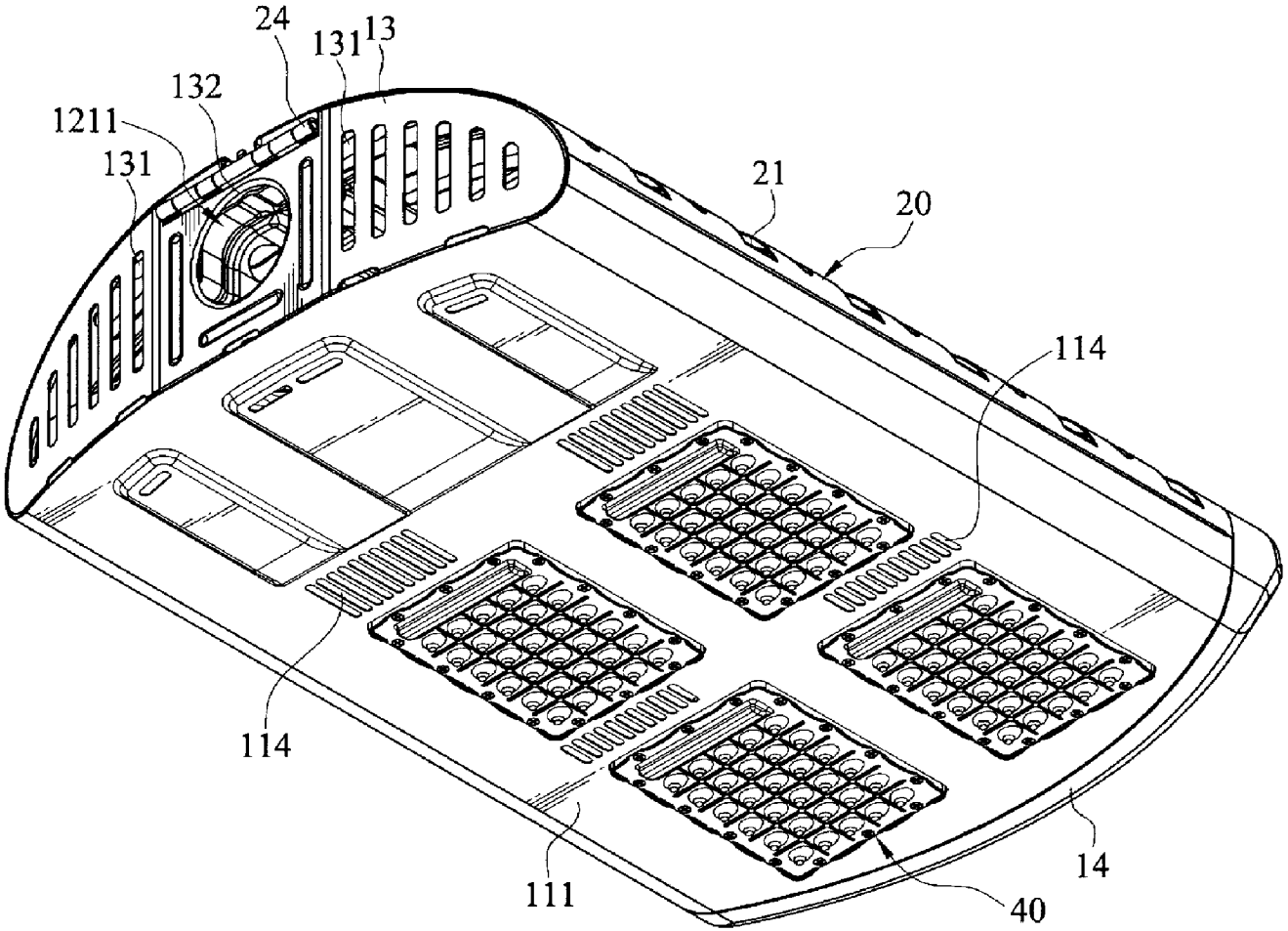
FIG. 7 is a schematic outside view of an embodiment of the present invention, as seen from another viewing angle.

The lamp housing component has a lamp base 10 and a lamp shade 20. The lamp base 10 comprises a case 11, a main bone 12, and two side plates 13 and 14. The case 11 has a bottom surface 111 (as shown in FIG. 7) and is opened with at least one accommodation hole 113 and a plurality of first air-inlet holes 114. The accommodation holes 113 are provided for assembling and positioning light emitting members 40. The accommodation holes 113 may be opened in the bottom surface 111, and the plurality of first air-inlet holes 114 is adjacent to side edges of the accommodation holes 113.

The main bone 12 has a sleeve 121, a rod 122, and at least one reinforcing member 123. The sleeve 121 is disposed at one end of the main bone 12 and has a slot 1211. The rod 122 is disposed at the other end of the main bone 12 and is joined to the sleeve 121, which is provided for locking and positioning heat sink members 30. One end of the reinforcing member 123 is locked on the rod 122, and the other end thereof is locked on the case 11. It should be particularly noted that, the accommodation holes 113 are respectively disposed at left and right sides of the main bone 12, and the heat sink members 30 are assembled on the rod 122 of the main bone 12 after the heat sink members 30 and the light emitting members 40 are installed in the accommodation holes 113. With such a structural design, if the light emitting luminance of the illumination device needs to be enhanced, only an extended main bone 12 and a case 11 with more accommodation holes 113 are required for replacement, so as to install more light emitting components (i.e., heat sink members 30 and light emitting members 40), such that the illumination device has the light source expandability.

Moreover, the two side plates 13 and 14 are respectively disposed at two opposite sides of the case 11. A plurality of second air-inlet holes 131 and an insertion hole 132 are opened in a surface of the first side plate 13, and a plurality of second air-outlet holes 141 is opened in a surface of the second side plate 14.

The lamp shade 20 is disposed on the lamp base 10 and forms an accommodation space with the case 11, the first side plate 13, and the second side plate 14. The lamp shade 20 comprises a plurality of first air-outlet holes 21. The structural configuration of the first air-outlet holes 21 is substantially described as follows. A plurality of grooves 23 is recessed in a surface 22 of the lamp shade 20, such that the grooves 23 and the surface 22 of the lamp shade 20 form stepped structures, and the stepped structures are formed into the first air-outlet holes 21.

During the assembly of the lamp base 10 and the lamp shade 20, firstly, the two side plates 13 and 14 are respectively soldered at two opposite sides of the case 11, and then the sleeve 121 of the main bone 12 is locked on the first side plate 13, such that the insertion hole 132 of the first side plate 13 is corresponding to the slot 1211 of the sleeve 121. In addition, the sleeve 121 further comprises a first shaft portion 1212, the lamp shade 20 similarly comprises a second shaft portion 24, and an axial rod 25 passes through the first shaft portion 1212 and the second shaft portion 24, such that the lamp base 10 and the lamp shade 20 are pivotally connected to each other. In this way, the lamp shade 20 is pivotally movable with respect to the lamp base 10.

The lamp base 10 further receives a power supply component 50, and the power supply component 50 may comprise a power supply, a power supply transformer, or other electronic control circuits (as shown in FIG. 3).

Figure 4:
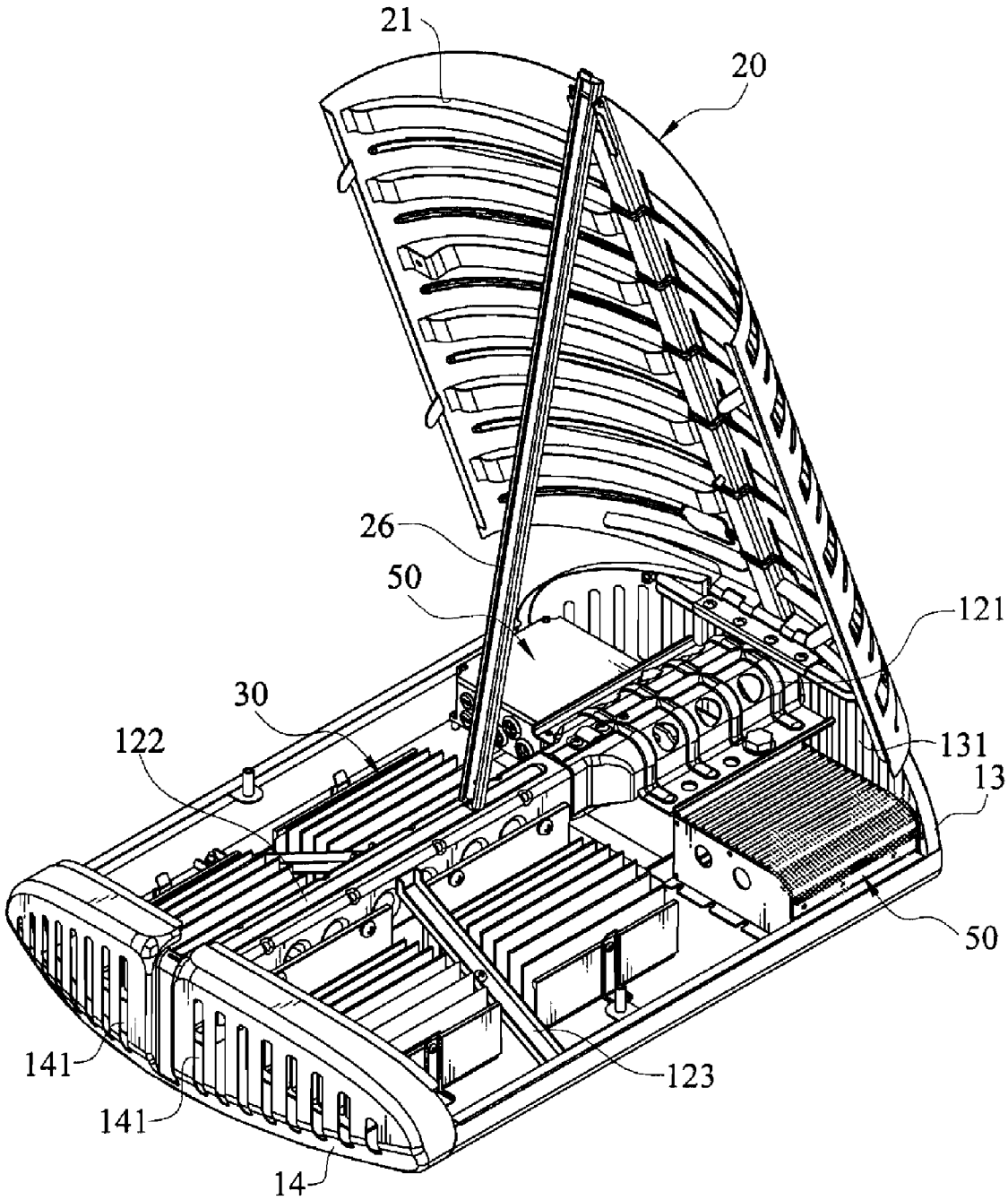
FIG. 4 is a schematic outside view of a lamp shade erected on a lamp base by using a supporting rod according to an embodiment of the present invention.

In addition, FIG. 4 is a schematic outside view of a lamp shade erected on a lamp base by using a supporting rod according to an embodiment of the present invention. As shown in FIG. 4, the lamp shade 20 further comprises a supporting rod 26 and has an accommodation groove 221 opened in the surface 22 (as shown in FIG. 2). The supporting rod 26 is pivotally mounted at one side edge of the lamp shade 20 and is pivotally moved between a receiving position where the supporting rod 26 is received in the accommodation groove 221 and an upright position where the lamp shade 20 is erected on the lamp base 10. In the receiving position, the supporting rod 26 is received in the accommodation groove 221 and is snapped to the second side plate 14 (as shown in FIG. 1). In the upright position, the supporting rod 26 rotates for over 180 degrees at the side edge of the lamp shade 20 and opens the lamp shade 20 to erect the lamp shade 20 on the lamp base 10 (as shown in FIG. 4), so as to facilitate the maintenance and replacement of the components inside the lamp base 10.

It should be particularly noted that, since the heat sink members 30 and the light emitting members 40 are assembled together as modular structures, when one of the light emitting members 40 fails or is damaged, only the corresponding heat sink member 30 needs to be individually dissembled from the rod 122 and the damaged light emitting member 40 needs to be taken out for maintenance, or the light emitting component is directly replaced by another new light emitting component (i.e., a heat sink member 30 and a light emitting member 40). In the actual application, the entire set of lamp does not need to be dissembled and replaced completely, such that the lamp can be rapidly and conveniently assembled and dissembled in the assembly or the future maintenance.

In addition, the light emitting components (i.e., the heat sink members 30 and the light emitting members 40) are locked at two opposite sides of the main bone 12 in a left-right symmetrical manner, which thus have desirable light distribution characteristics. Moreover, with the structural design of disposing the plurality of light emitting components at the two opposite sides of the main bone 12, the light emitting components are respectively corresponding to the plurality of first air-inlet holes 114, and the plurality of first air-inlet holes 114 respectively guides an air flow to blow the corresponding light emitting components, such that each light emitting component effectively enjoys the heat dissipation effects realized in a manner of heat exchange, thereby achieving a desirable flow field design.

Figure 5:
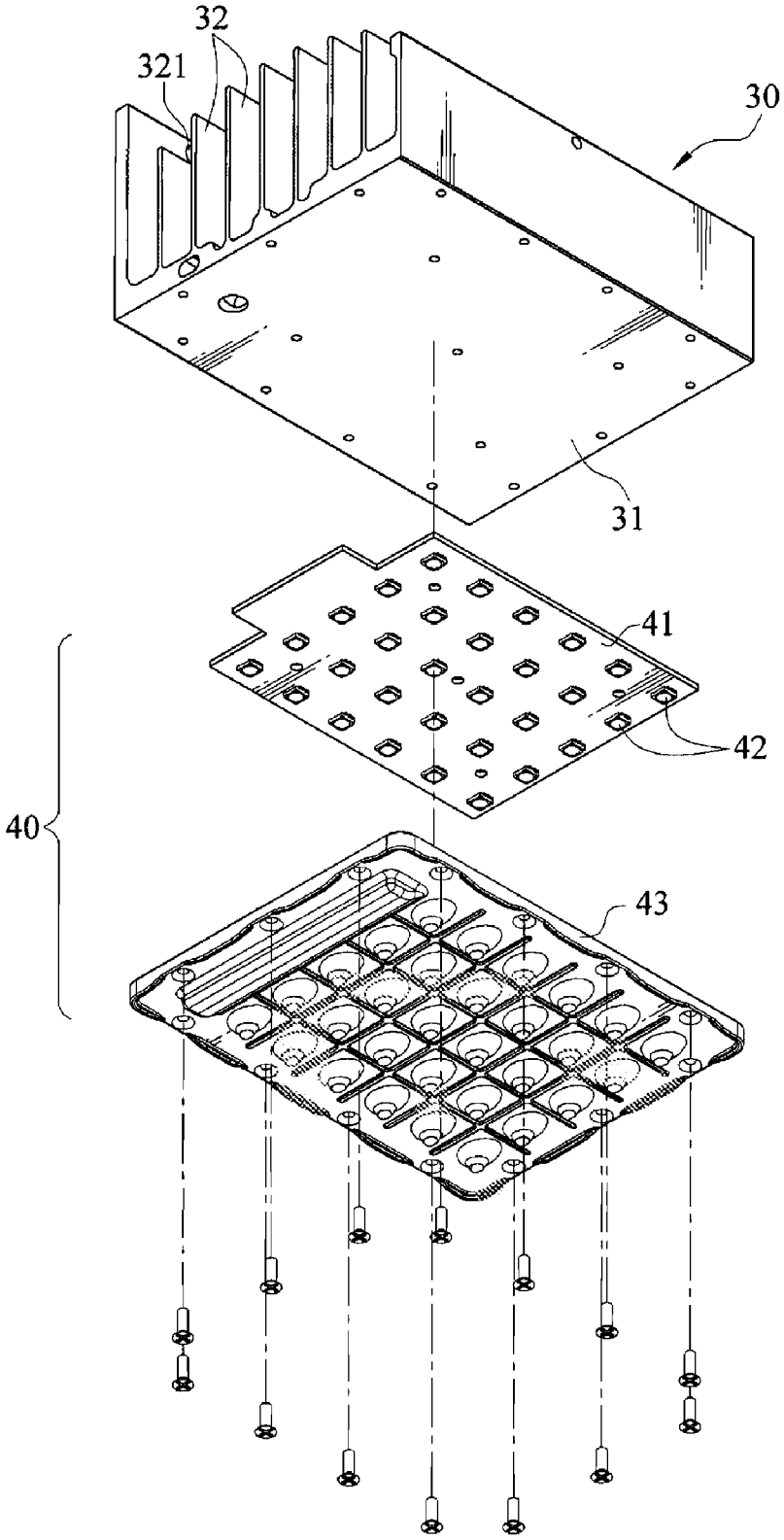
FIG. 5 is a schematic exploded view of a heat sink member and a light emitting member according to an embodiment of the present invention.
Figure 6:
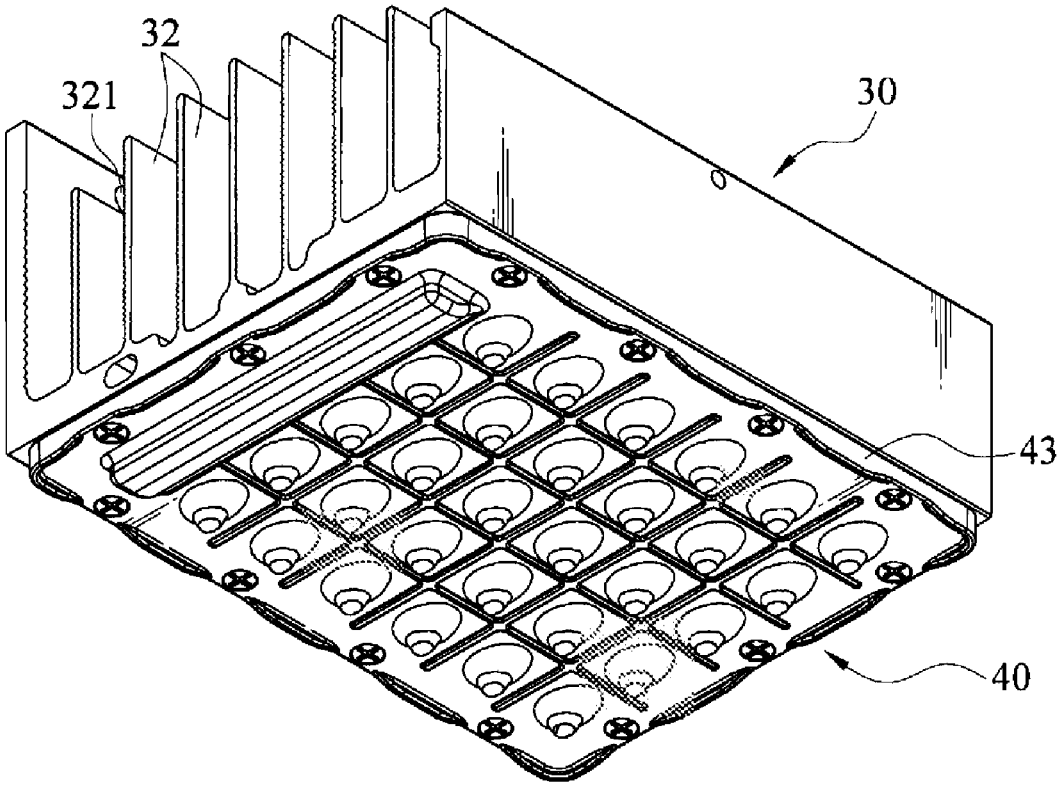
FIG. 6 is a schematic assembled view of the heat sink member and the light emitting member according to an embodiment of the present invention.

Moreover, FIG. 5 is a schematic exploded view of a heat sink member and a light emitting member according to an embodiment of the present invention, FIG. 6 is a schematic assembled view of the heat sink member and the light emitting member according to an embodiment of the present invention, and FIG. 7 is a schematic outside view of an embodiment of the present invention, as seen from another viewing angle.

As shown in FIGS. 5 to 7, the light emitting component has a heat sink member 30 and a light emitting member 40. The heat sink member 30 further comprises a contact portion 31 and a heat sink portion 32. The heat sink portion 32 is disposed on the contact portion 31 in a form of a plurality of fins, in which an air flow channel is formed among the fins. The light emitting member 40 comprises a circuit board 41, an LED 42, and a secondary optical member 43. The circuit board 41 is low-thermal-resistance MC-PCB, at least one LED 42 is electrically connected to the circuit board 41, and the secondary optical member 43 is disposed on the circuit board 41 and covers the LED 42.

Then, the heat sink member 30 and the light emitting member 40 are assembled together, such that the contact portion 31 of the heat sink member 30 is attached to the circuit board 41 of the light emitting member 40. When the LED 42 works, the heat energy generated by the LED 42 is transferred from the circuit board 41 to the contact portion 31 and then uniformly conducted to the heat sink portion 32 by the contact portion 31. Afterwards, the assembled heat sink member 30 and light emitting member 40 are disposed in the accommodation hole 113 of the lamp base 10, and then at least one locking element 33 passes through at least one locking hole 321 of the heat sink portion 32 and is locked in a corresponding locking hole 1221 on the rod 122, such that the heat sink member 30 is fixed on the rod 122. In addition, at least one fixing member 15 is further disposed on the lamp base 10 and erected at a side edge of the accommodation hole 113. After being locked on the rod 122, the heat sink member 30 is further securely positioned on the lamp base 10 by using the fixing member 15, in which the fixing member 15 is connected to the other side edge of the heat sink portion 32 in a locking manner or a snapping manner.

It should be particularly noted that, after the heat sink members 30 and the light emitting members 40 are assembled in the accommodation holes 113, a set of first air-inlet holes 114 may be opened adjacent to each accommodation hole 113. In other words, a set of first air-inlet holes 114 is provided at one side edge of each heat sink member 30 in a one-to-one corresponding manner (as shown in FIG. 3). In this way, after entering via each set of first air-inlet holes 114, an outside cold air flow performs a heat exchange convection for each heat sink member 30, such that each heat sink member 30 is blown by the cold air flow to remove the heat energy and each heat sink member 30 is subjected to the same heat dissipation condition. Thus, a uniform temperature status is maintained in the accommodation space, so as to prevent the heat energy from being accumulated at a certain specific position of the lamp base 10.

Figure 8:
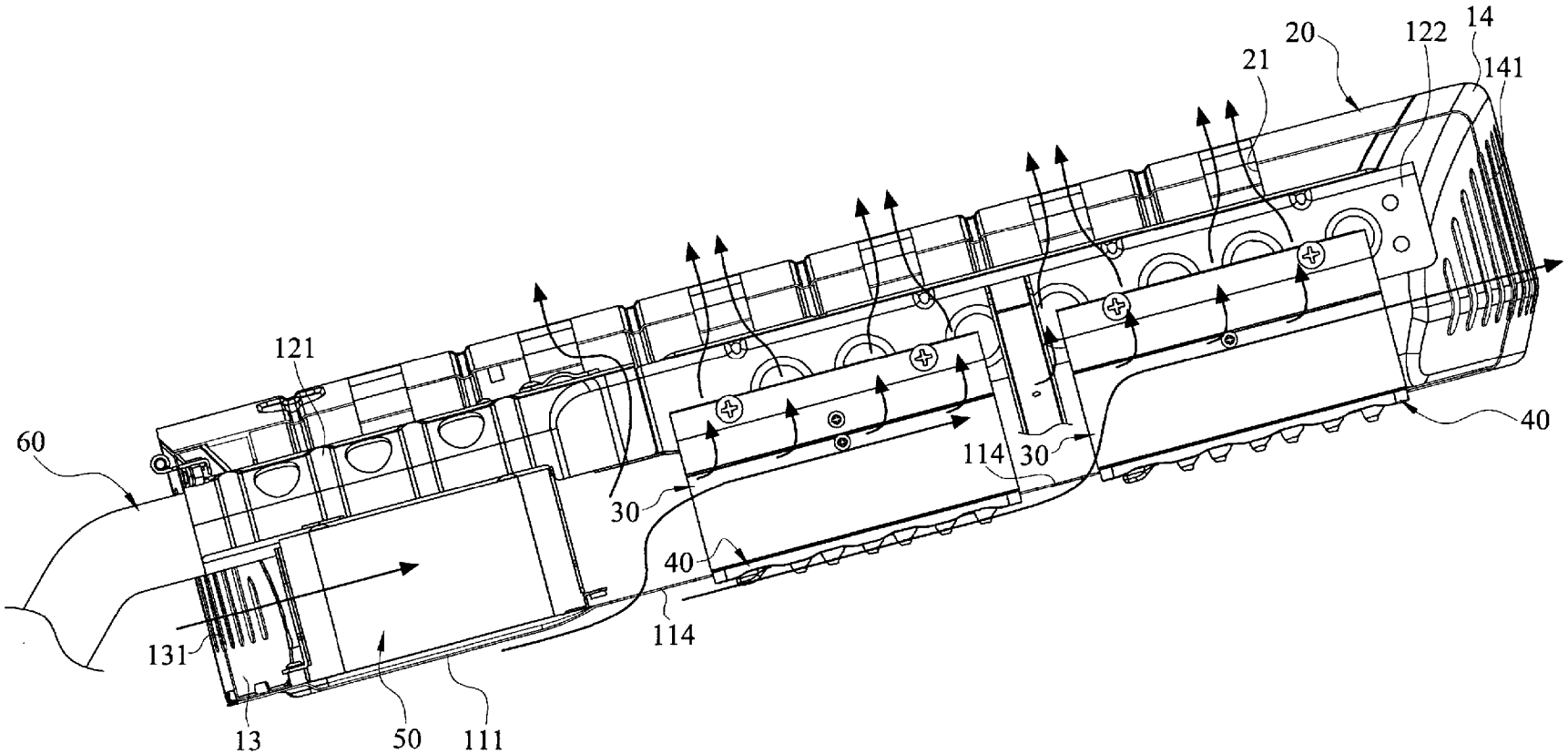
FIG. 8 is a schematic view of flowing motions of an air flow according to an embodiment of the present invention.

Moreover, FIG. 8 is a schematic view of flowing motions of an air flow according to an embodiment of the present invention. As shown in FIG. 8, a lamp rod 60 is inserted into the slot 1211 of the sleeve 121 through the insertion hole 132 of the first side plate 13, and then the lamp rod 60 is clamped and fixed towards the slot 1211 by a clamper 124 (as shown in FIGS. 3 and 8), such that the lamp housing component forms an inclined illumination angle. When a plurality of LEDs 42 emits lights, the light source may be diffused uniformly by the secondary optical members 43, and the secondary optical members 43 of the light emitting members 40 have the same lighting pattern. Once the circuit board 41 absorbs the high-temperature heat energy generated by the LED 42, the contact portion 31 rapidly absorbs the high-temperature heat energy due to the close attachment between the contact portion 31 of the heat sink member 30 and the circuit board 41, and then uniformly conducts the heat energy to the heat sink portion 32. In this way, the heat energy is uniformly diffused to any position of the heat sink portion 32 and a heat collecting area is formed in the accommodation space between the lamp base 10 and the lamp shade 20.

In other words, the heat collecting area is full of hot air flow, and the volume of the hot air flow is expanded and the density thereof is reduced, such that a temperature difference is generated between the temperatures inside and outside the lamp housing component. Due to the temperature difference, the air flows inside and outside the lamp housing component have different densities, so that the hot air flow gradually rises and is discharged from the first air-outlet holes 21 or the second air-outlet holes 141, and meanwhile the cold air flow enters the lamp base 10 for supplement from the first air-inlet holes 114 or the second air-inlet holes 131 and removes the heat energy on the heat sink portion 32 once again, and so forth. Thus, the heat energy of the heat sink members 30 is transmitted out of the lamp housing component through the air flows, so as to form a cyclic natural convection cooling.

Figure 9:
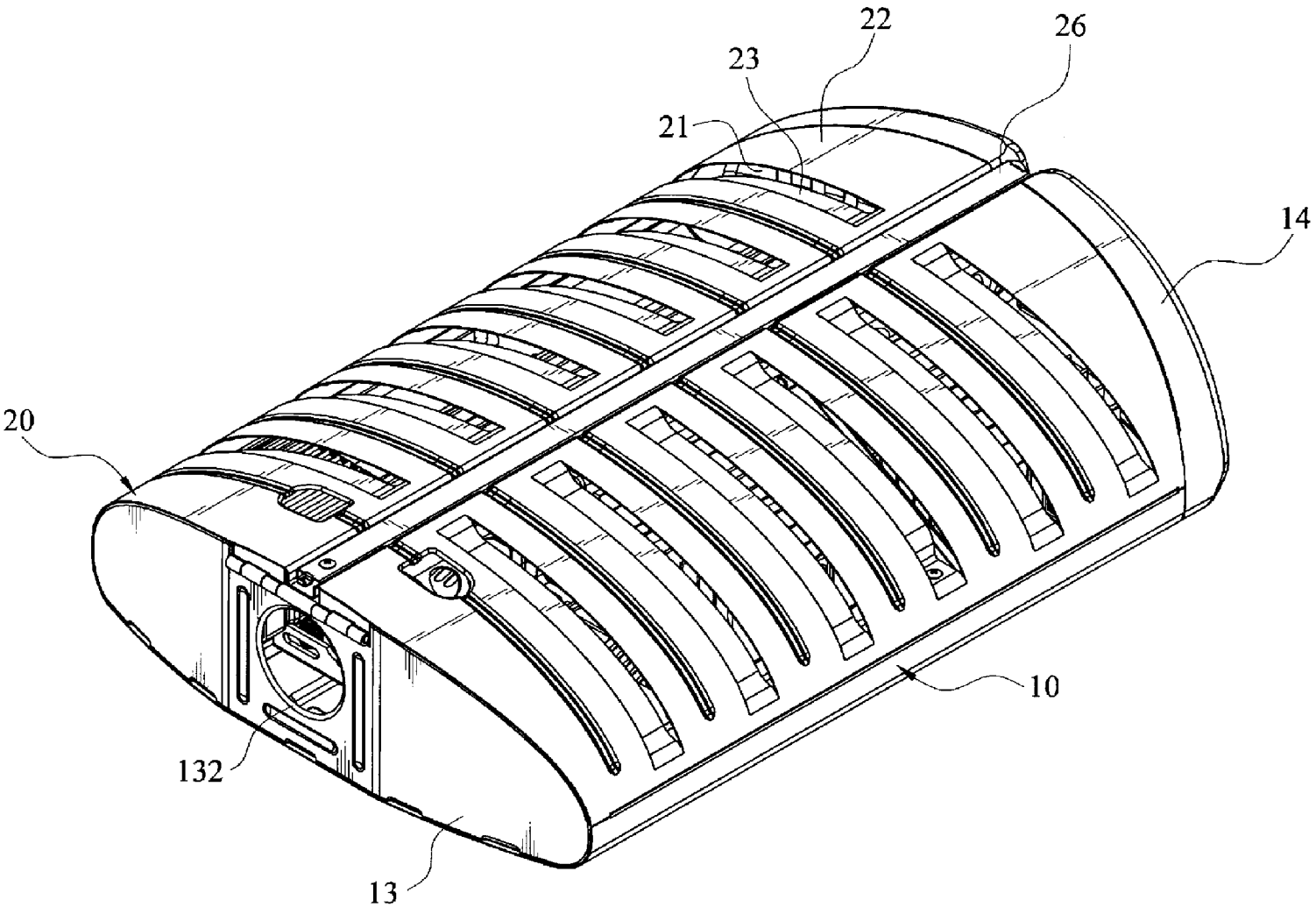
FIG. 9 is a schematic outside view of another embodiment of the present invention.
Figure 10:
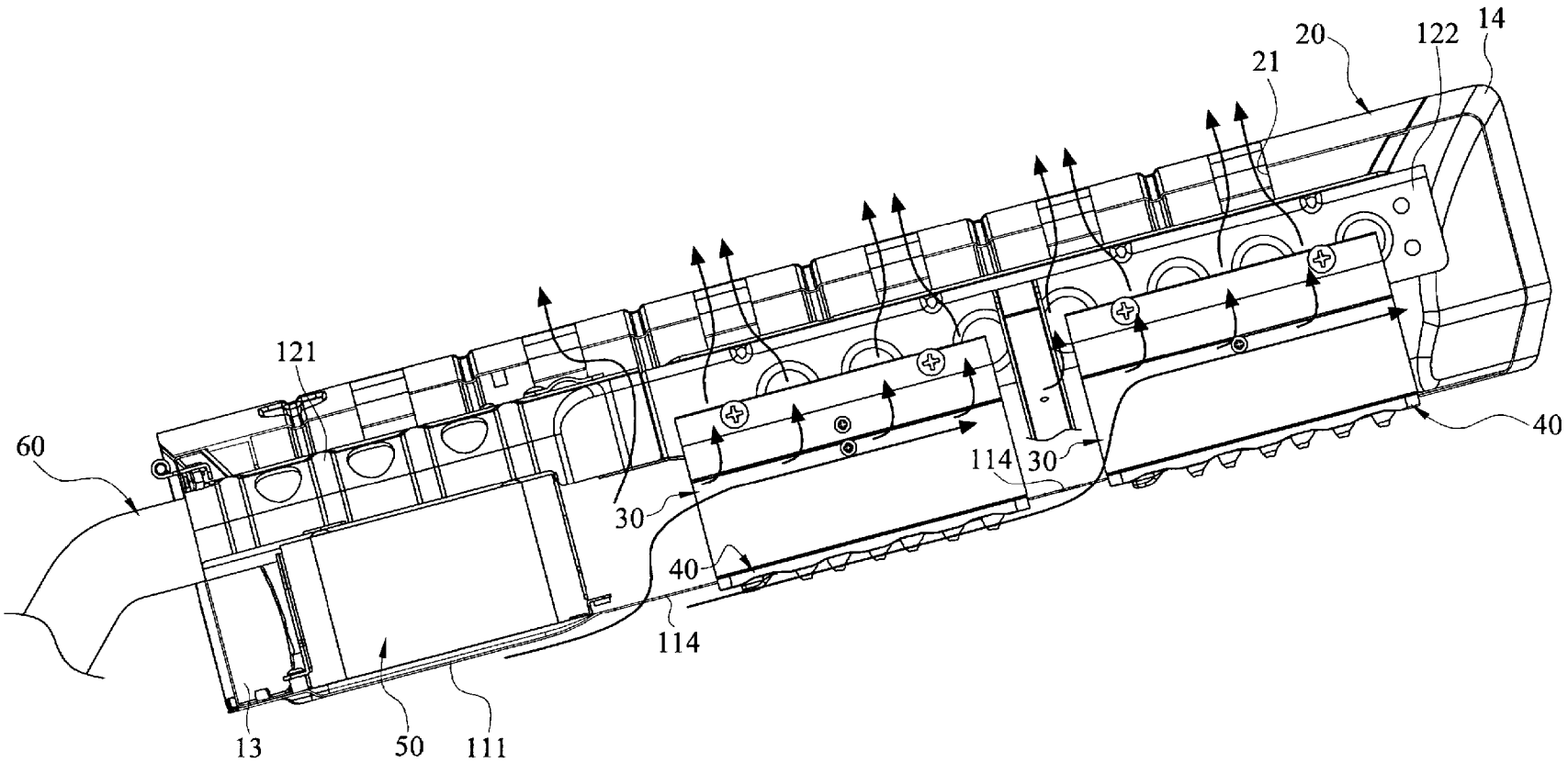
FIG. 10 is a schematic view of flowing motions of an air flow according to another embodiment of the present invention.

FIG. 9 is a schematic outside view of another embodiment of the present invention, and FIG. 10 is a schematic view of flowing motions of an air flow according to another embodiment of the present invention. The specific implementation in this embodiment is substantially the same as that of the above embodiment, and only the difference there-between is illustrated below. In this embodiment, a plurality of first air-inlet holes 114 is opened in the lamp base 10 and a plurality of first air-outlet holes 21 is opened in the lamp shade 20, without opening air-inlet holes or air-out holes in the first side plate 13 and the second side plate 14, such that the hot air flow is discharged out of the lamp housing component from the plurality of first air-outlet holes 21, and the cold air flow enters the lamp housing component from the plurality of first air-inlet holes 114, so as to form a single cyclic heat exchange convection.

What is claimed is:

1. An illumination device, comprising:

a lamp housing component, further comprising:

a lamp base, having a plurality of first air-inlet holes; and a lamp shade, having a plurality of first air-outlet holes;

a main bone, disposed on the lamp base of the lamp housing component; and at least one light emitting component, further comprising:

a heat sink member, disposed inside the lamp housing component and connected to the main bone; and a light emitting member, disposed on the lamp housing component and contacting the heat sink member;

wherein the first air-inlet holes are respectively corresponding to the light emitting components and respectively guide an air flow to blow the light emitting components correspondingly, and the air flow is discharged from the first air-outlet holes, such that all the light emitting components are subjected to a heat dissipation convection of the air flow.

2. The illumination device according to claim 1, wherein the lamp shade and the main bone are respectively provided with a first shaft portion and a second shaft portion corresponding to each other, and an axial rod passes through the first shaft portion and the second shaft portion, such that the lamp shade and the lamp base are pivotally connected to each other and the lamp shade is pivotally movable with respect to the lamp base.

3. The illumination device according to claim 1, wherein the lamp base further comprises:

a first side plate, disposed at one side edge of the lamp base and joining the lamp base to the lamp shade, wherein the first side plate has a plurality of second air-inlet holes; and a second side plate, disposed at the other side edge of the lamp base and joining the lamp base to the lamp shade, wherein the second side plate has a plurality of second air-outlet holes, corresponding to the first side plate.

4. The illumination device according to claim 1, wherein the lamp base further has at least one accommodation hole for disposing the light emitting components, and the accommodation holes are respectively adjacent to side edges of the first air-inlet holes.

5. The illumination device according to claim 1, wherein the lamp shade further comprises a supporting rod, and the supporting rod is pivotally mounted on the lamp shade and pivotally moved between a receiving position where the supporting rod is flatly attached to the lamp shade and an upright position where the supporting rod erects the lamp shade on the lamp base.

6. The illumination device according to claim 1, wherein the main bone further comprises:

a sleeve, disposed at one end of the main bone and provided for a lamp rod to be inserted therein; and a rod, disposed at the other end of the main bone and joined to the sleeve, wherein the light emitting components are locked on the rod.

7. The illumination device according to claim 6, wherein the sleeve further comprises at least one reinforcing member and two opposite ends of the reinforcing member are respectively locked on the rod and the lamp housing component.

8. The illumination device according to claim 1, wherein the heat sink member further comprises:

a contact portion, for contacting the light emitting member; and a heat sink portion, disposed on the contact portion in a form of a plurality of fins, wherein an air flow channel is formed among the fins.

9. The illumination device according to claim 1, wherein the light emitting member further comprises:

a circuit board, being a low-thermal-resistance metal core printed circuit board (MC-PCB) and contacting the heat sink member;

at least one light emitting diode (LED), electrically connected to the circuit board; and a secondary optical member, disposed on the circuit board and covering the LED.

10. The illumination device according to claim 1, wherein corresponding light emitting components are respectively disposed at two opposite sides of the main bone.

* * * * *